United States Patent [19]

Fisher

[11] 3,960,086

[45] June 1, 1976

[54] AIR VALVE SAFETY DEVICE FOR BOMB FUZES

[75] Inventor: Evan D. Fisher, Chevy Chase, Md.

[73] Assignee: The United States of America as represented by the Secretary of the Army, Washington, D.C.

[22] Filed: Feb. 28, 1975

[21] Appl. No.: 554,339

[52] U.S. Cl. ..... 102/70.2 G; 89/1.5 D; 102/81

[51] Int. Cl.[2] ..... F42C 5/00; F42C 15/12

[58] Field of Search ..... 102/70.2 G, 70 R, 76, 102/81, 2; 89/1.5 D, 1.812

[56] References Cited

UNITED STATES PATENTS

| | | | |
|---|---|---|---|
| 2,922,340 | 1/1960 | Wilkie | 89/1.5 D |
| 2,939,102 | 5/1960 | Johnson | 89/1.5 D |
| 3,757,695 | 9/1973 | Fisher | 102/70.2 G |
| 3,866,535 | 2/1975 | Hedeen et al. | 102/81 X |

*Primary Examiner*—David H. Brown

*Attorney, Agent, or Firm*—Nathan Edelberg; Robert P. Gibson; Saul Elbaum

[57] ABSTRACT

An environmental safety device for a fuzed bomb which is prevented from being actuated until both the bomb has been positively released from the aircraft and has separated a predetermined distance from the bomb rack. The device comprises a spring-actuated air valve, which when released, extends from the charging well of the bomb such that an inlet port is placed in the slipstream of air flowing thereby. The slipstream is directed via a flexible conduit to an air-actuated fuze located in the nose of the bomb. An exhaust tube encircles the inlet tube so as to direct the exhaust air back through the valve outlet port. A preferred embodiment employs a high performance, point detonation dual channel redundant fuze.

8 Claims, 5 Drawing Figures

AIR VALVE SAFETY DEVICE FOR BOMB FUZES

RIGHTS OF THE GOVERNMENT

The invention described herein may be manufactured, used, and/or licensed by or for the United States Government for governmental purposes without the payment to me of any royalty thereon.

BACKGROUND OF THE INVENTION

1. Field of the Invention

This invention is related to safety and arming systems for high-explosive bomb fuzes and, more particularly, to an air valve safety device utilized to provide an environmental signature for a high performance air-actuated bomb fuze.

2. Description of the Prior Art

Bomb fuzing systems presently utilize relatively outdated and sometimes unreliable point detonation mechanical fuzes. While being relatively inexpensive, such fuzes suffer from various defects. These include a propensity to malfunction upon encountering trees or other foliage prior to reaching an optimum detonation point. Further, the safety and arming systems associated with such fuzing devices are not as safe or reliable as they should be, and in fact, they do not comply with present day military requirements of providing two positive environmental signatures prior to arming.

Proposals have been made to modernize certain electric bomb fuzes by, for example, utilizing slipstream actuated charging systems that utilize environmental ram air to generate electrical energy within the bomb itself, thereby dispensing with the special electric charging gear formerly required onboard the aircraft. Such an approach is exemplified by my prior U.S. Pat. No. 3,757,695. While generally satisfactory, the approach described therein suffered from a major deficiency in not providing the necessary two environmental signatures prior to arming. Furthermore, the charging device could be accidentally exposed to slipstream air while in flight which would tend to pose a rather serious hazard. Other proposals, such as air scoops and the like, have also failed to take into account the undesirable effect of an accidental release or actuation of the device prior to the bomb's release from the aircraft. In modern high performance bombs with are wing-mounted on the outside of the aircraft, wind forces become significant; it is therefore essential to provide an airtight and failsafe system to ensure reliability and safety.

Another problem exists with respect to the design of the two laterally-spaced/suspension lugs utilized to retain the bomb on the bomb rack prior to release. Each suspension lug is generally of an inverted U-configuration, the bottom portion of which is secured to the body of the bomb. A single, releaseable hook or latch extends from the bomb rack through the upper portion of each lug. Such U-shaped lugs are generally satisfactory in that they allow air to flow substantially unimpeded therethrough after release of the bomb such that a sufficient amount of ram air reaches the slipstream actuated charging device which is positioned in the charging well of the bomb between the two suspension lugs. However, such U-shaped suspension lugs proved to be unsatisfactory in that they tended to permit the bomb to sway from side to side. To alleviate the sway problem, a new design of suspension lug has been introduced. The new lug is T-shaped and is designed so that each lug has a pair of hooks or latches from the bomb rack cooperating therewith. While largely eliminating bomb sway, after release the T-shaped lug presents a rather solid obstruction to the slipstream of air needed to actuate the charging devices located aft of the lug on the longitudinal surface of the bomb. Accordingly, a new technique is needed which is compatible with the preferred T-shaped suspension lugs and which obviates the foregoing and other problems.

OBJECTS AND SUMMARY OF THE INVENTION

It is therefore a primary object of the present invention to provide a safety device for a high performance air actuated fuze bomb which overcomes all the disadvantages noted above with respect to prior art systems.

A further object of the present invention is to provide an environmental safety device utilized for fuzed bombs which is foolproof, reliable, has a minimum of moving parts, is inexpensive, and is easily adaptable to existing bomb structures.

Another object of the present invention is to provide an air valve device for bomb fuzes that is dependent for its actuation upon the positive release of the bomb from the aircraft and the travelling of the device a prescribed minimum distance from the bomb rack.

A still further object of the present invention is to provide an air valve device for a bomb fuze which may be easily and safely reset if accidentally tripped prior to loading the bomb on the aircraft, and which, if tripped after loading on the aircraft, still needs to be dropped therefrom prior to arming of its associated fuze.

A still additional object of the present invention is to provide an air valve safety device for a bomb fuze which is compatible both with the standard U-shaped suspension lugs and the new T-shaped lugs.

The foregoing and other objects are attained in accordance with one aspect of the present invention through the provision of a safety device for a fuzed bomb which comprises an air valve positioned within a receiving well along the central longitudinal surface of the bomb. The air-valve device comprises an inner, spring loaded head member having an inlet port and an outlet port formed therein. The head member is held within an outer housing by a release mechanism while the bomb and the head member are in their stowed positions. Upon the positive release of the release mechanism, along with the positive separation of the bomb from the bomb rack, the head member essentially pops up to expose the inlet port within the slipstream of air flowing along the surface of the bomb. The ram air is directed via an internally positioned tube to an air-actuated point detonation fuze located immediately aft of the steel nose cover of the fuze. Exhaust air is directed via an exhaust tube formed about the inlet tube and exhausts through the air valve exhaust port.

BRIEF DESCRIPTION OF THE DRAWINGS

The foregoing and other objects, aspects and uses and advantages thereof will become more fully apparent as the same becomes better understood when considered in connection with the following detailed description of the present invention when viewed in conjunction with the accompanying drawings, in which.

DETAILED DESCRIPTION OF THE PREFERRED EMBODIMENT

Figure 1:
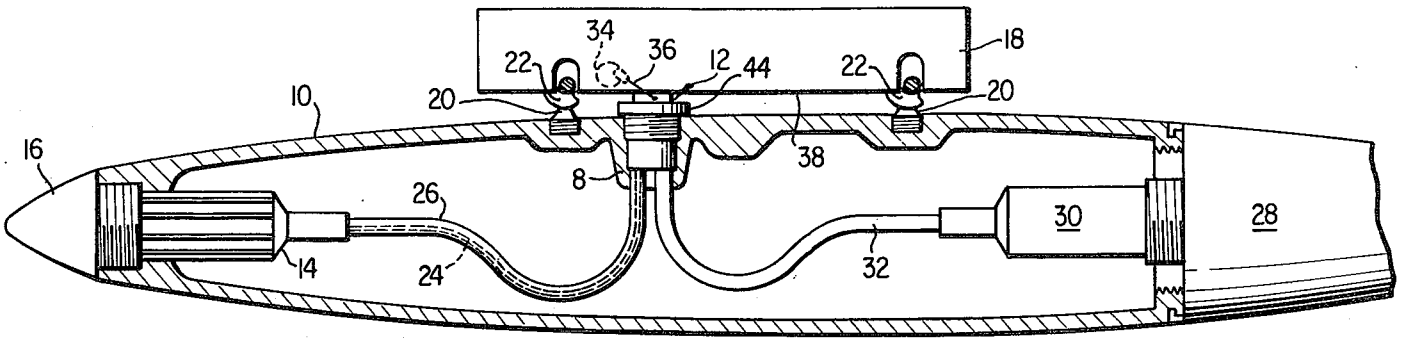
FIG. 1 is a schematic side view and partial cross-section of a bomb mounted in its bomb rack and incorporating the fuze system of the present invention.

Referring first to FIG. 1, a high explosive, general purpose bomb is illustrated generally at 10 and is seen to include a centrally located receptacle or charging well 8 positioned along the longitudinal periphery thereof. Located fore and aft of charging well 8 are a pair of suspension lugs 20. Suspension lugs 20 are appropriately attached to bomb 10 and serve as means for suspending bomb 10 from a standard bomb rack 18 as shown. Bomb rack 18 has a pair of movable hooks or latches 22 which grasp suspension lugs 20 when the bomb is in its stowed position. Conventional control means (not shown) actuable by the pilot of the aircraft serve to release bomb 10 by rotating latches 22 out of engagement with suspension lugs 20, all of which is conventional in the art. As mentioned hereinabove, suspension lugs 20 may be either of the standard U-shaped type requiring only a single hook to suspend the same, or may alternatively be of the newer T-shaped type which require a pair of hooks both fore and aft to grasp each lug. As mentioned previously the provision of the pair of hooks 22 for each T-lug 20 is intended to minimize the effects of sway or play of the bomb 10 while suspended from rack 18. In contradistinction, the standard U-shaped lug requires only a single hook or latch 22 for each lug 20.

Figure 5:
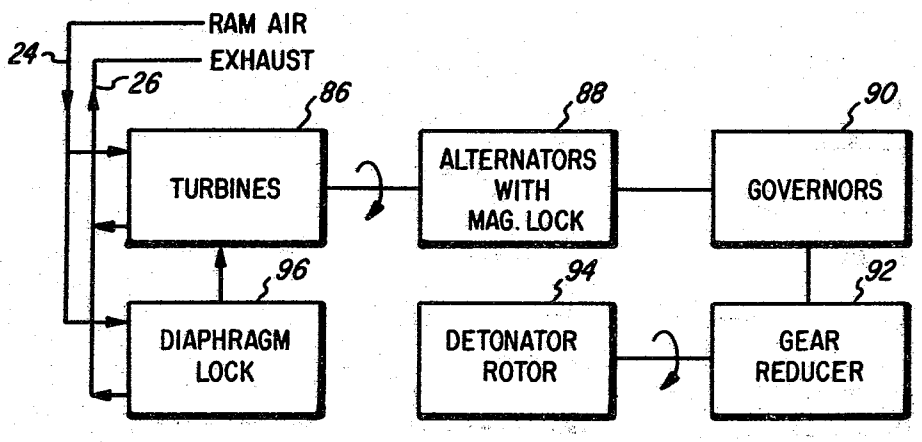
FIG. 5 is a block diagram of the electro-mechanical fuze system.

Bomb 10 also includes a removable nose plug 16 which preferably comprises a five inch diameter steel nose piece. Inserted well behind the standard nose plug 16 is a nose fuze 14 which is preferably a high performance, point detonation (PD) air-actuated nose fuze. Nose fuze 14 is preferably a dual-channel, redundant fuze which utilizes redundancy features similar to those described in connection with a companion mortar fuze, as described in HDL-TR-1577, "High-Performance PD Fuse for Mortar and Artillery", December, 1971. As described in more detail in copending application Ser. No. 595,189 filed July 11, 1975 and assigned to the same assignee as the present application, and illustrated in FIG. 5 fuze 14 preferably consists of a redundant two-channel electro-mechanical system which employs two air driven turbines 86. The inlet ram air to drive the turbines 86 in fuze 14 is provided by means of a plastic tube or conduit 24 which is connected at its inlet end to a valve device 12, described in more detail hereinafter, which is shown in FIG. 1 in its stowed or inactive position. The air driven turbines 86 of fuze 14 drive independent electric alternators 88 having shafts, which in turn, drive governors 90 that regulate constant speed gear-reducing assemblies 92. The constant speed gear-reducing assemblies rotate detonator-containing independent rotors 94 from a safe in-line position to a fully armed position. A diaphragm lock 96 is provided on rotating elements to prevent the rotation thereof until a differential pressure is developed between the inlet and exhaust ports of air valve device 12. Furthermore, an inherent magnetic lock of each of the alternators within fuze 14 prevents the rotation thereof until a minimum air velocity threshold is attained. Exhaust air from fuze 14 is delivered by means of outer tubing 26, which is formed around inner tubing 24, to an exhaust port in valve device 12. In order to provide the additional environmental signature required by present military standards, a barometric pressure sensing element is included within fuze 14 to activate the timing circuit thereof. The barometric pressure sensing element activates when it experiences a difference in altitude of, for example, 1000 feet, thereby providing approximately eight seconds of free fall as a minimum safe separation distance. The circuitry of fuze 14 includes redundant impact/shock switches, as well as delay functions which are cross-coupled in each channel to ensure high reliability. Selection of delay functions may be accomplished simply by removing nose plug 16.

Bomp 10 is also seen to include a tailfin 28, a fuze seat liner 30, and a conduit 32 connecting fuze seat liner 30 with charging well 8. Fuze seat liner 30 and its associated conduit 32 are illustrated only so as to provide an indication of a standard general purpose bomb which includes such standard elements. However, they are not utilized in accordance with the preferred embodiment of the present invention. FIG. 1 also illustrates a valve device 12 connected to bomb rack 18 via a lanyard wire 36 releasable by a schematically illustrated solenoid 34. It is noted that in the stowed position of bomb 10 illustrated in FIG. 1, valve device 12 essentially abuts or is immediately adjacent to the underside 38 of bomb rack 18 so as to prevent the extension thereof even if lanyard 36 is accidentally actuated, as will become more clear hereinafter.

Figure 2:
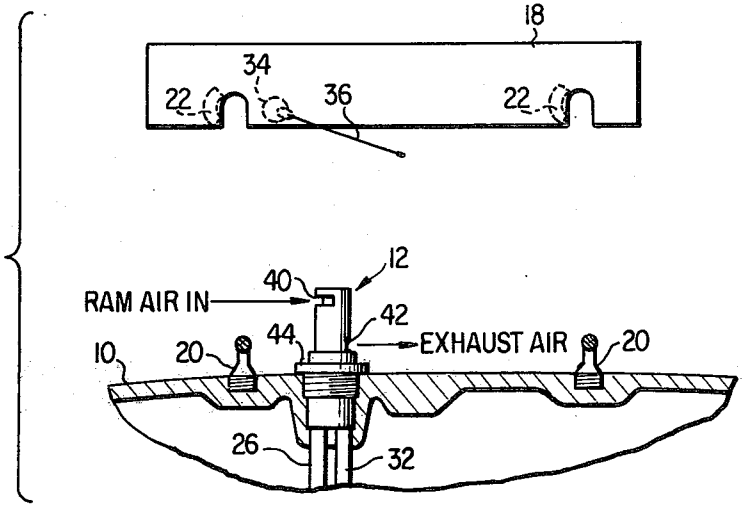
FIG. 2 is a partial view of the apparatus shown in FIG. 1 but is with respect to the point in time just after the bomb has been released from the bomb rack.

Referring now to FIG. 2, a portion of the bomb 10 is shown just after its release from bomb rack 18. It is clear from FIG. 2 that suspension lugs 20 remain with the bomb after release and further that lanyard 36 has acted positively upon valve device 12 so as to release the head thereof as shown. Ram air provided by the slipstream moving longitudinally along the surface of bomb 10 enters an input port 40 of valve device 12 and, after performing its generating function within fuze 14, exits through output port 42. Valve device 12 is thus seen to essentially comprise a pop-up air valve which may be placed in its operative positive only upon the occurrence of the following events. First, latches 22 of bomb rack 18 must be positively moved from their latching position shown in FIG. 1 so as to be disengaged from suspension lugs 20 to allow bomb 10 to be released from rack 18. The foregoing action further removes the constraint imposed by the underside 38 of bomb rack 18 on the movable head member of valve device 12. After bomb 10 has separated from bomb rack 18 a predeterminable minimum amount as defined by the length of arming lanyard 36, the latter acts to release, in a manner to be described in more detail hereinafter, the spring loaded head member of valve device 12 so as to project input port 40 into the slipstream of ram air. It should further be noted that no viable air flow may be entertained from input port 40 through exhaust port 42 until the latter also clears retaining nut 44 of the valve device 12. That is to say, the head member of valve device 12 must be fully extended before any air may flow through the system to positively initiate the arming functions of the fuze. It should further be noted with respect to FIG. 2 that input port 40 extends appreciably above the obstruction presented by the forwardly located suspension lug 20 so as to minimize any air impedance presented thereby.

Figure 3:
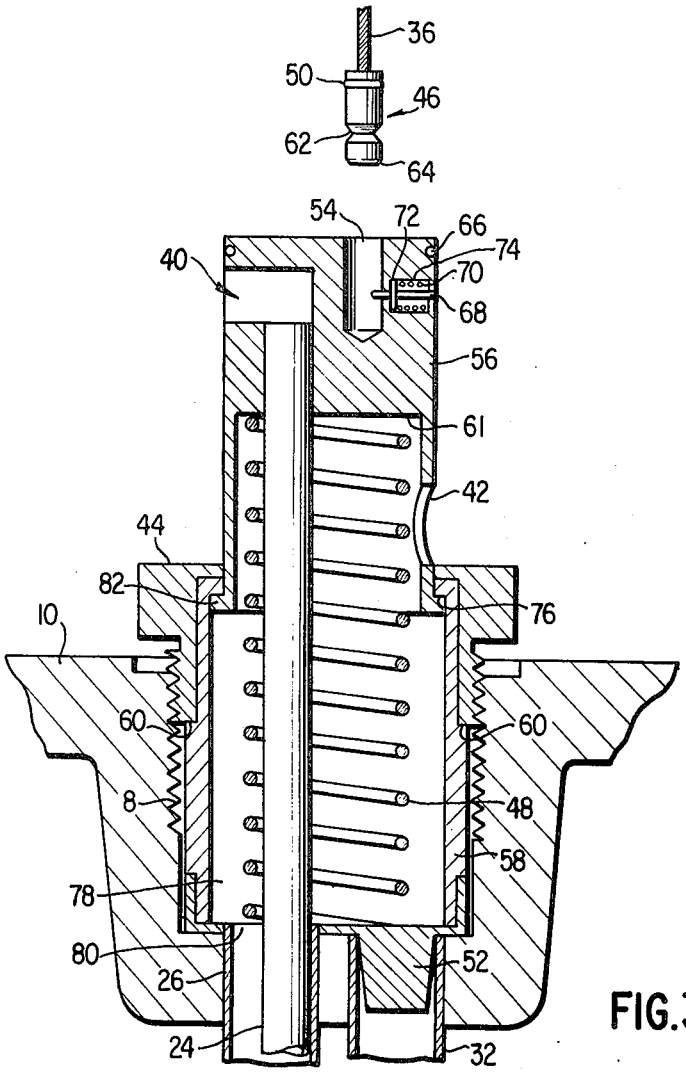
FIG. 3 is a more detailed cross-sectional view of the air valve safety device in accordance with a preferred embodiment of the present invention shown in its extended position.
Figure 4:
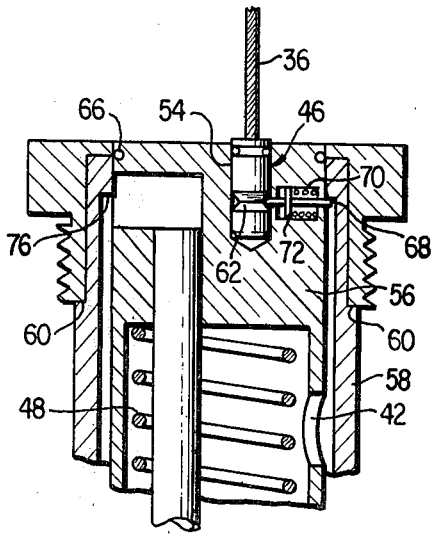
FIG. 4 is a cross-sectional view showing the essential components of the valving device of FIG. 3 while in its stowed position.

Referring now to FIGS. 3 and 4, there is illustrated a preferred embodiment of the air valve device 12 in accordance with the present invention. Valve device 12 comprises an outer housing 58 within which is positioned an inner movable head member 56. Outer housing 58 is firmly seated within charging well 8 by means of a nut 44 which engages the upper retaining shoulder 60 of housing 58. Located within an inner hollow area 78 of housing 58 and head member 56 is an actuating spring 48 which is engaged on the one hand with the bottom of housing 58, and on the other hand with the bottom surface 61 of head member 56 so as to bias the latter outwardly.

FIG. 3 illustrates the valve device 12 just subsequent to the release of head member 56, while FIG. 4 illustrates the stowed position of head member 56 prior to the positive actuation of lanyard 36. It is noted from FIG. 3 that head member 56 has formed therein input port 40 and exhaust port 42. Ram air entering input port 40 is directed via plastic tubing 24 to air-actuated fuze 14, as aforedescribed. Formed about plastic tube 24 is another tubing 26 for the conduction of exhaust air from fuze 14 through an aperture 80 in the base of head member 56 through the inner hollow area 78 to finally exhaust through the exhaust port 42 of head member 56.

Arming lanyard 36 has attached at one end thereof a release pin 46, the other end of arming lanyard 36 being connected to the solenoid device 34 of bomb rack 18 as aforedescribed. Release pin 46 has formed peripherally at the lower mid section thereof a recessed groove 62. At the lower portion of release pin 46 is formed a cam surface 64, while near the upper end of pin 46 is positioned an O-ring 50.

Release pin 46 is adapted to be fitted in a pin-receiving longitudinal channel 54 formed in head member 56. Also formed in head member 56, transversely to longitiudinal channel 54, is a transverse channel 74. Transverse channel 74 houses a transfer pin 68 having a spring stop member 72 formed thereabout to define a limit for a spring 70.

Referring now to FIG. 4, the stowed position of head member 56 is illustrated wherein release pin 46 is shown engaged within longitudinal channel 54 by virtue of the abutment of the inner end of transfer pin 68 with recessed groove 62. The spring force of spring member 70 acting against the disc-like stop member 72 forces the transfer pin 68 to be maintained in position as shown. Further, the outer end of transfer pin 68 abuts against an inwardly extending shoulder 76 of housing 58 so as to prevent the force exerted by erection spring 48 from outwardly ejecting inner member 56.

In operation, when a tension from approximately forty to seventy pounds is applied to the arming wire 36, release pin 46 is withdrawn from longitudinal channel 54. This, in turn, forces transfer pin 68 to the right, as viewed in FIG. 4, against the spring force of spring 70. When release pin 46 is completely withdrawn from channel 54, spring 70 forces stop member 72 and hence transfer pin 68 to the left, as viewed in FIG. 4, to the position viewed in FIG. 3 wherein stop member 72 rests against the innermost surface of transverse channel 74. In this position, transfer pin 68 no longer abuts the shoulder 76 of housing 58. This allows the force of actuating spring 48 to extend head member 56 outwardly until it attains the resting position shown in FIG. 3 and defined by the abutment of the lower shoulder stop members 82 of head member 56 with the inwardly extending shoulder 76 of housing 58. When fully extended, as seen in FIG. 3, the input port 40 of head member 56 allows ram air to enter, travel via the plastic tube 24 to fuze 14 and thence from fuze 14 through exhaust tube 26 to exhaust port 42. Thus, a positive air flow may thus be obtained.

To reset the valve device 12 of FIG. 3, head member 56 must first be manually reinserted within outer housing 58. Thereafter, release pin 46 may be manually reinserted within longitudinal channel 54. The camming action of lower cam surface 64 of pin 46 against the innermost end of transfer pin 68 forces the latter outwardly and allows pin 46 to be further reinserted until alignment of pin 68 and groove 62 is achieved, as seen in FIG. 4.

It is seen by virtue of the foregoing that I have provided a highly reliable safety feature for use with bomb fuzes in which no modification is required to the aircraft since standard suspension and release features may be maintained. The air valve utilizes a heavy actuating spring which ensures that it will be extended to its maximum height to place the ram air inlet port in an unobstructed position regardless of the nature of the suspension lugs utilized. The fuze itself requires two environmental signatures for arming: firstly, the ram air must be admitted via the air valve device as described above, while secondly the barometric pressure sensitive element must sense a differential pressure which normally occurs after a fall of approximately 1000 feet. The air velocity must be equivalent to approximately 250 knots in order to activate the barometric pressure sensing element and the turbine. Further, dynamic pressure must be established and maintained on the air supply line and flow must be exhausting for a finite period of time before the fuze may become armed.

If for some reason the air valve device is accidentally released prior to the loading of the bomb onto the bomb rack, it should be apparent from FIG. 1, that the bomb may not be physically loaded onto the rack. Further, the extended valve serves as a visual indication to the loading crew of a premature release to enable corrective action to be taken. Even if the valve device is released prior to the loading of the bomb, the lack of any substantial air flow will prevent the arming of the bomb and further will enable the air valve to be easily and safely reset. Another unique safety feature of the present invention is the inherent interference presented to the air valve device while the bomb is suspended from the bomb rack on the aircraft. The dynamic air supply required for fuze operation may not be established until the valve device has been extended the approximately 1½ in. necessary to uncover the exhaust port. The actual clearance between the lower surface of the bomb rack and the bomb's upper surface is, for example, approximately ⅝ in. The head member of the valve device occupies nearly all of this space in its stowed position to thereby leave only enough clearance to load the weapon on the rack. If for any reason the valve is accidentally released while the bomb is still in its rack loaded position, the environmental air signature may not accidentally arm the bomb since the ports are still closed. During the remote possibility of having a bomb hang-up on its rear suspension lug while the valve device has been released, the fuze explosive elements may become aligned, but the second environmental signature due to the barometric pressure sensing element will not be forthcoming and the fuze functioning circuits will remain disconnected to provide the pilot the opportunity to employ other measures to correct the situation.

Location of the fuze within the fuze well with a solid nose plug provides additional protection and safety by precluding accidental fuze damage during storage and loading operations. The air valve device in the bomb center charging well is protected in a similar manner by the bomb suspension lugs fore and aft of the charging well.

Other advantages accrue from the internal concentric tube air conduit configuration described above. Studies conducted indicated that the percentage of pressure available in the fuze nose well compared with the dynamic ram air pressures for various velocities was greatest at the lower velocities. As the velocities increased, the percentage of pressure decreased, a highly desirable feature since it provides a form of inherent speed regulation to prevent over-driving at high terminal velocities.

Many modifications of the above will be obvious to a person of ordinary skill in the art. It is therefore to be understood that within the scope of the appended claims the invention may be practiced otherwise than as specifically described herein.

I claim as my invention:

1. A safety device for a fuzed bomb, which comprises:

a fuzed bomb having a receptacle positioned along the longitudinal surface thereof, a nose plug covering the frontal portion thereof, and means located adjacent said receptacle for suspending said bomb from a bomb rack when in its stowed position;

an air-actuated fuzing device positioned within said frontal portion of said bomb behind said nose plug and including means for generating electrical energy in response to said slipstream air received from said air valve means;

air valve means positioned within said receptacle for admitting slipstream air to said fuzing device only after said bomb is released from said stowed position and has separated a predetermined minimum distance from said bomb rack; and conduit means connected between said air-valve means and said fuzing device for conducting said slipstream air towards said fuzing device and for conducting exhaust air towards said air-valve means.

2. The safety device as set forth in claim 1 wherein said air-valve means comprises a movable head member in which are formed an input port for receiving said slipstream air and an exhaust port through which said exhaust air is released.

3. The safety device as set forth in claim 2 wherein said conduit means comprises a first tube within which said exhaust air is conducted and a second tube, positioned within said first tube, within which said slipstream air is conducted.

4. The safety device as set forth in claim 3, wherein said air-valve means further comprises an outer housing secured within said receptacle and within which said movable head member is retained while in its stowed position, actuating spring means for urging said head member outwardly, and means for releasing said head member from within said outer housing only after said bomb is released from its stowed position and has separated a predetermined minimum distance from said bomb rack.

5. The safety device as set forth in claim 4, wherein said head member is positioned adjacent the underside of said bomb rack when said bomb is in its stowed position.

6. The safety device as set forth in claim 5, wherein said means for releasing said head member comprises:

a lanyard having a release pin connected to one end thereof, the other end of which has means for connecting to said bomb rack;

a longitudinal channel formed in said head member for slidably receiving said release pin;

a transverse channel formed in said head member, said transverse channel having a transfer pin positioned therein;

means for biasing said transfer pin into engagement with said release pin while said head member is in said stowed position.

7. The safety device as set forth in claim 6, wherein said outer housing includes an inwardly extending shoulder against which said transfer pin is positioned while in said stowed position to maintain said head member within said outer housing.

8. The safety device as set forth in claim 7, wherein said release pin includes a recessed groove formed circumferentially thereabout with which said transfer pin is engaged while in said stowed position, and a lower cam surface means for facilitating repositioning of said release pin within said longitudinal channel by camming said transfer pin outwardly.

* * * * *